United States Patent [19]

Naffier

[11] 4,187,532

[45] Feb. 5, 1980

[54] ELECTRONIC CANDLE

[76] Inventor: Vernon H. Naffier, 899 Laurel St., Dubuque, Iowa 52001

[21] Appl. No.: 918,068

[22] Filed: Jun. 22, 1978

[51] Int. Cl.[2] ..... F21L 7/00

[52] U.S. Cl. ..... 362/186; 362/202; 362/276; 362/392

[58] Field of Search ..... 362/186, 190, 202, 276, 362/392

[56] References Cited

U.S. PATENT DOCUMENTS 3,340,391 9/1967 Heyden ..... 362/190

*Primary Examiner*—Stephen J. Lechert, Jr.

[57] ABSTRACT

An electronic, battery-operated candle using an electric lamp incorporates a light-activated silicon control rectifier circuit which permits the candle to be ignited or turned on by another candle or other external light source. The electronic candle also includes an air-pressure switch located near the electric lamp which permits the candle to be extinguished by blowing at the candle head which houses said lamp and switch. The device is so constructed that it may be easily disassembled for removal and replacement of batteries and bulb without disturbing the other circuit components.

4 Claims, 12 Drawing Figures

ELECTRONIC CANDLE

The subject matter herein disclosed is an electronic candle similar to but representing major improvements in the simulated candle using an electric lamp. The advantages of the electronic candle compared with the prior invention are light-activated ignition and air-pressure extinguishment as over against on-off switching which is accomplished by means of a manually-operated switch.

The electronic candle is designed to permit lighting of one said candle from another lit candle or other light source in a manner analogous to lighting a wax candle from the flame of another wax candle. The electronic candle is also designed in such manner that its light is extinguished in the same fashion as the flame of a wax candle is extinguished, namely, by blowing.

The object of the electronic candle is to preserve the aesthetic value and customary use of wax candles and to serve as a substitute for said wax candles especially where the use of wax candles may be prohibited by fire regulations. The electronic candle also allows preservation of the symbolism of "passing on" the light in candle-lighting ceremonies wherein a candle is ignited by another candle already lit. The foregoing objects are not realized either fully or in part in the prior invention comprising an electric candle with conventional on-off switch.

Another object of the particular device herein described is facile disassembly and reassembly for the purpose of removing and replacing the consumable parts, namely, the batteries and light bulb, without disturbing or damaging other more delicate parts in the device.

Figure 1:
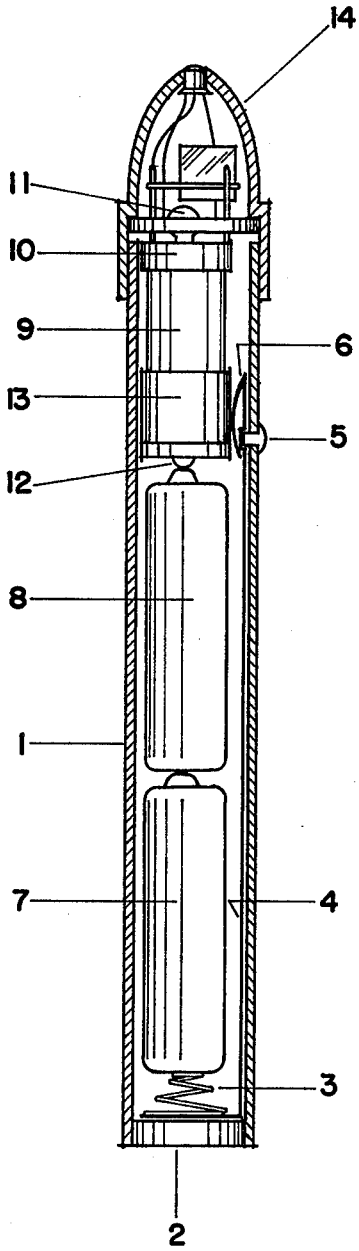
FIG. 1 is a full scale vertical, sectional view of the electronic candle.

Referring to the drawing, the improved simulated candle using an electric lamp comprises an elongated structure or tubular candle housing 1 (FIG. 1) constructed of cardboard or plastic and closed at its lower end by means of a circular wooden or plastic disc 2 inserted into the lower end of the candle housing 1 and permanently secured thereto by a strong adhesive. A small, electrically conductive compression spring 3 is attached to an electrically conductive resilient strip 4 which is placed vertically against the inside wall of the candle housing 1, said spring 3 being disposed atop the disc 2. The strip 4 is secured by means of a rivet 5 near the upper end of said strip 4 to the candle housing 1. The single rivet 5 in combination with a suitable thickness of the strip 4 serves to permanently secure in place the combination comprising said spring 3 and said strip 4. The upper end of the electrically conductive strip 4 is bent down and back against itself to form a resilient electrical contact 6 extending outward slightly from the inside wall of the candle housing 1.

The candle housing 1 contains a direct current electrical energy source comprising two size AA $1\frac{1}{2}$ volt batteries 7 and 8 positioned with positive poles in upward direction. The negative or bottom end of the lower battery 7 makes electrical contact with the compression spring 3. The cnadle housing 1 also accepts into itself a tubular light bulb cartridge 9 wherein is disposed a cartridge socket 10 at the upper end thereof to receive a light-generating element or electic light bulb 11 which is of the miniature type rated at $1\frac{1}{2}$ to 2 volts and drawing 200 milliamps or less of current. The light bulb cartridge 9 makes electrical contact at its bottom end through the electrical contact stub 12 with the positive pole of the upper battery 8 and also makes electrical contact at its lower side through electrically conductive sleeve or ring 13 with mating electrical contact 6 which forms the upper end of the electrically conductive strip 4. The ring 13 allows the cartridge 9 to make electrical contact with contact end 6 of strip 4 regardless of the axially rotated position of the cartridge 9 in the candle housing 1.

Detachably secured to the upper end of the candle housing 1 is a transparent plastic protective housing or candle head 14 which encloses, among other parts to be enumerated and described further below, the miniature light bulb 11 which protrudes above the cartridge socket 10 and above upper end of the candle housing 1. While affording protection to the bulb 11, the candle head 14 allows light from the bulb 11 to be transmitted therethrough.

Figure 2:
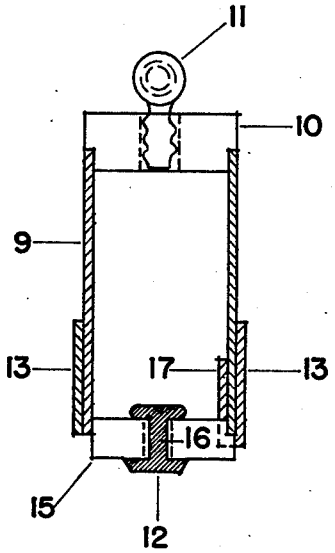
FIG. 2 is a vertical, sectional view of the light bulb cartridge.
Figure 3:
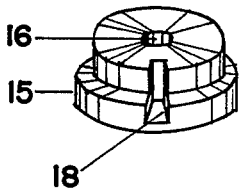
FIG. 3 is an isometric view of bottom end disc to said cartridge.
Figure 4:
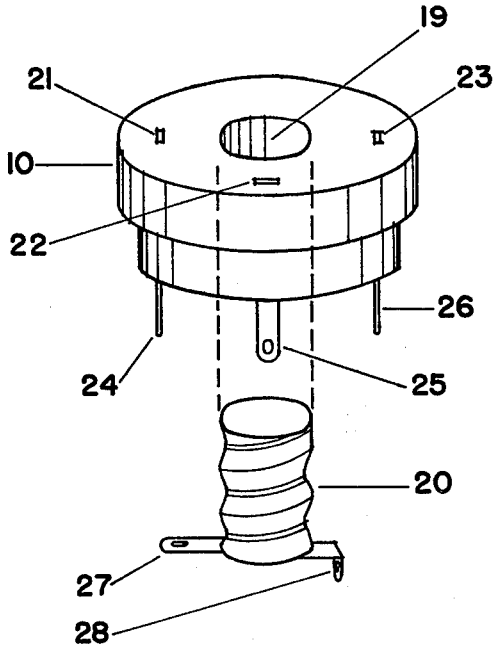
FIG. 4 is an isometric view of the cartridge socket.
Figure 5:
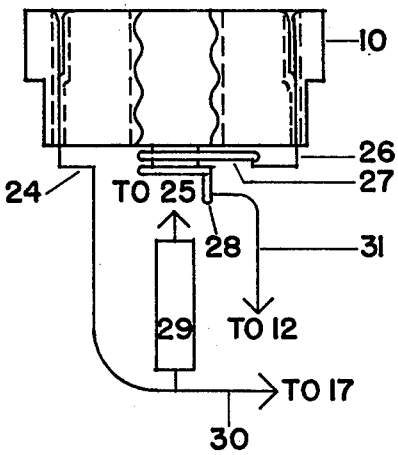
FIG. 5 is a vertical view of the cartridge with wired components shown.

The cartridge 9 shown in more detail in FIG. 2 is closed at its bottom end by means of a plastic disc 15, secured thereto by a strong adhesive, with center hole 16 (represented by dotted lines in FIG. 2) through which rivet 12 serving as an electrical contact stub protrudes. The above-described electrically conductive ring 13 fits over the bottom end of the cartridge 9, said ring 13 having a tab 17 bent over bottom edge of cartridge 9 and extending upward along inside wall thereof. In FIG. 3 disc 15 contains a recessed portion or notch 18 for accommodating the tab 17. A cartridge socket 10 (FIG. 2) is mounted in top end of the cartridge 9 and secured thereto by a strong adhesive. The cartridge socket 10 (FIG. 4) of molded plastic comprises a light bulb socket 20 which fits snugly in center aperture 19 of said cartridge socket 10; three vertical openings 21, 22, and 23 arranged around and equidistantly from center aperture 19; and pin sockets 24, 25, and 26 which are accommodated in the cartridge socket 10 through said openings 21, 22, and 23. The light bulb socket 20 has two electrically conductive tabs 27 and 28 at bottom end thereof one of which 27 (FIG. 5) is joined to pin socket 26 by soldering. A resistor 29 with a value in the neighborhood of 22 thousand ohms is connected across the two remaining pin sockets 24 and 25 (the latter pin socket is not shown in FIG. 5 in order not to obscure tabs 27 and 28). An electrical conductor 30 connects pin socket 24 to ring tab 17. The remaining light bulb socket tab 28 is connected by means of an insulated electrical conductor 31 to the electrical contact stub 12 located at the center of the disc 15.

Figure 6:
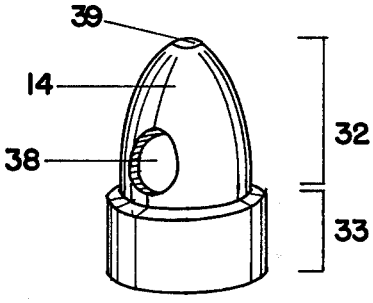
FIG. 6 is a perspective view of the candle head.
Figure 7:
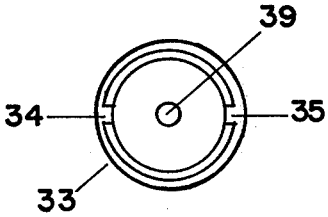
FIG. 7 is a bottom view of the candle head without the pin base.
Figure 8:
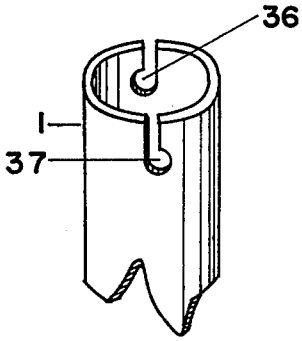
FIG. 8 shows the top portion of the candle housing in a perspective view.
Figure 9:
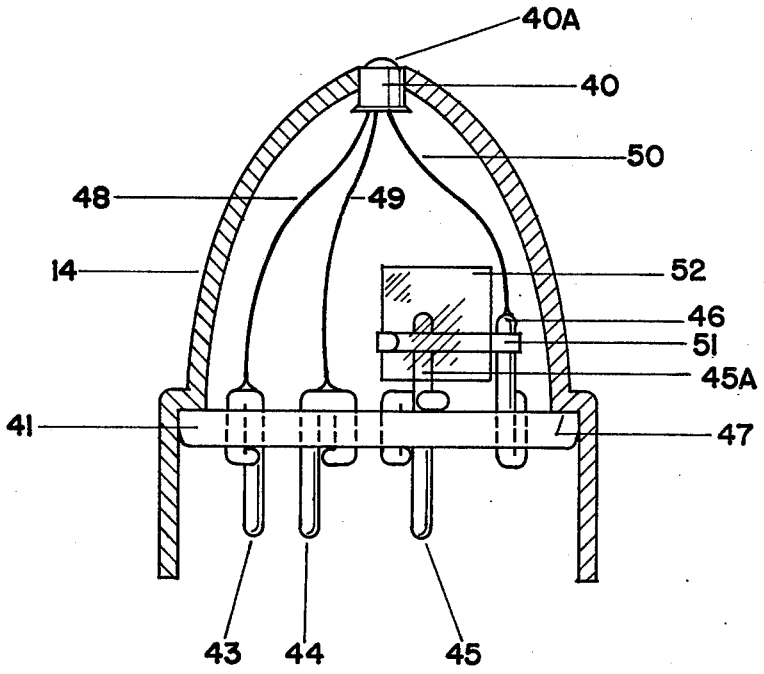
FIG. 9 is a vertical, sectional view of the candle head.

The candle head 14 (FIG. 6) comprises a molded hollow transparent plastic form with rounded, conically-shaped upper portion 32 and cylindrical lower portion or base 33, said base 33 having two plastic tabs or bayonet prongs 34 and 35 (FIG. 7) protruding from the inside circumference of said base 33 at the bottom edge thereof, said prongs 34 and 35 positioned diametrically opposite one another. The prongs 34 and 35 cooperate with bayonet slots 36 and 37 (FIG. 8) disposed in the top end of the candle housing 1, in order to provide means for detachably securing the candle head 14 to the candle housing 1 by pushing down and turning candle head 14 on said candle housing 1. Said candle head 14 has a wide aperture 38 (FIG. 6) at the side thereof for admitting air current and another smaller aperture 39 at the vertex thereof to accommodate a light-activated silicon control rectifier 40 (FIG. 9), hereinafter referred to be the conventional abbreviation LASCR, the lens 40*a* thereof facing upward from the vertex of the candle head 14.

The candle head 14 contains a plurality of parts including said LASCR 40 and a molded plastic or bakelite circular plate or pin base 41 (shown also in FIG. 10) with center aperture 42 to allow clearance for the miniature light bulb 11, and with metal pins 43, 44, and 45 (FIG. 9) secured thereto and extending downward therefrom around and equidistant from said center aperture 42. Two terminal means or wire posts 45*a* and 46 are mounted to top side of pin base 41, said post 45*a* being an extension of pin 45. The gate lead 48 of the LASCR 40 is soldered to top end of pin 43; the anode lead 49 of the LASCR 40 is soldered to top end of pin 44; and the cathode lead 50 of the LASCR 40 is soldered to the top of post 46. Secured by soldering to post 46 is a small electrically conductive resilient strip 51 which extends to and makes contact with post 45*a* on the side of post 45*a* facing the center of pin base 41. Said strip 51 forms a switch in normally closed position with post 45*a*. Attached to the back side of strip 51 facing the center of pin base 41 is a thin but firm, transparent acetate plate or wind sail 52 as a means for receiving air current directed thereto. The wind sail 52 must not be in contact with the strip 51, in order not to impede the spring action of said strip 51, except at the end thereof closest to post 45*a*, at which end the wind sail 52 is permanently secured to the strip 51, and at a slight angle to strip 51. In order to lend rigidity to the point where the strip 51 is connected to the wind sail 52, so that resiliency is operable only along the strip 51 and not between the strip 51 and the wind sail 52 at the junction thereof, the portion of strip 51 making contact with the wind sail 52 is tinned with solder prior to the joining together of the two said parts 51 and 52.

The pin base 41 is positioned against the inside peripheral ledge 47 at upper end of the base 33 of the candle head 14 and secured thereto by a strong bond adhesive. The aperture 38 in the candle head 14 must be positioned directly in front of the wind sail 52, and the LASCR 40 must be inserted into the aperture 39 of the candle head 14.

Figure 10:
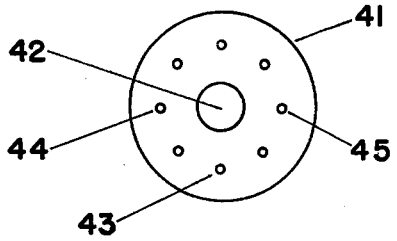
FIG. 10 is a bottom view of the candle head pin base.
Figure 11:
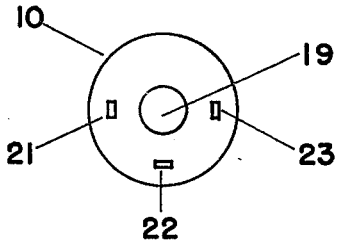
FIG. 11 is a top view of the cartridge socket.

The pins 43, 44, and 45 in the pin base 41 cooperate with the pin sockets 21, 22, and 23 in the cartridge socket 10 in order to connect the candle head 14, both mechanically and electrically by means of the pin-and-socket arrangement, to the light bulb cartridge 9. FIG. 10 shows the bottom view of the pin base 41 and the arrangement of the pins 43, 44, and 45 therein. FIG. 11 shows the top view of the cartridge socket 10 and the arrangement of the pin socket apertures 21, 22, and 23 therein.

Figure 12:
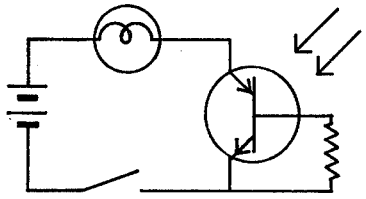
FIG. 12 is a diagrammatic view of the electronic candle circuitry.

The circuit of the electronic candle is shown in diagrammatic form in FIG. 12.

In operation, the electronic candle is ignited or turned on by tilting it toward another light source so that the tip or vertex of the candle head is placed directly against the other light source, much in the same manner as a wax candle is safely lit by tilting it toward another candle in upright position which is already lit. The LASCR is turned on by the external radiant means or light source permitting the light bulb of the electronic candle to be energized by the batteries. To extinguish the electronic candle, the user simply blows abruptly and sharply at the aperture of the candle head. The air current strikes the wind sail located just behind the aperture in the candle head causing the resilient metal strip to which the wind sail is attached to be depressed, which action opens the circuit thus causing the light bulb to go out. As soon as the blowing stops, the resilient metal strip springs back into an "on" position, but the light bulb fails to light up again, because the LASCR remains turned off until reactivated by an external light source.

The sensitivity of the candle's circuitry is such that the candle will not be turned on by ordinary room light. The igniting external light source, which may be another electronic candle, a match flame, a flashlight or a lamp, as examples, must be placed directly against the tip of the candle head. Flourescent lighting will not turn on the electronic candle at any distance. On the other hand, the candle will light up automatically in very bright indoor incandescent light or in direct sunlight. To prevent the electronic candle from turning on unintentionally, the candle should not be directly exposed to very bright light.

In order to replace worn out batteries the user simply removes the candle head by turning and then pulling the candle head away from the candle housing. The whole assembly including the light bulb cartridge and the candle head is thus easily removed as one piece, and the batteries may then be removed from the candle housing. In order to replace a burned out bulb, the same procedure as outlined above for removal of the candle head is followed. Then the candle head is simply unplugged from the light bulb socket cartridge. The bulb will be exposed at the top end of the cartridge and may be unscrewed for removal. A new bulb is then inserted, and the candle head is plugged back into the light bulb cartridge.

Modified embodiments of the improvement in the simulated candle using an electric lamp include substitution of a circuit comprising a phototransistor, silicon control rectifier and a gate current amplifying transistor for the LASCR; and an air-pressure switch which turns off the candle by means of shunting the anode and cathode of the LASCR rather than opening the circuit as described in the foregoing part of this specification. Drawings for these modifications and detailed disclosure thereof are not included in this specification since such modifications are not regarded herein as the best mode of operation of the improvements described herein.

The following claims are set forth:

I claim:

1. An improved simulated candle using an electric lamp, said device comprising an elongated structure housing a direct current electrical energy source, a light generating element energized by said electrical energy source, disposed at top end of said elongated structure;

a first means located adjacent to said light-generating element for allowing said light-generating element to be energized by said electrical energy source when said light-generating element is momentarily brought into close proximity with an external radiant means, said light-generating element remaining energized after said external radiant means is withdrawn; a second means located adjacent to said light-generating element for de-energizing said light-generating element by means of air movement directed toward said second means, said second means cooperating with said first means in such manner that said first means remains continuously operable; and a third means for disposing said first two means in the candle structure in said manner as to afford first two said means protection from damage in ordinary usage without hampering easy accessibility to said electrical energy source and said light-generating element for removal and replacement thereof.

2. An improved simulated candle as defined in claim 1 wherein said first means for allowing said light-generating element to be energized comprises a light-activated silicon controlled rectifier connected in series with said light-generating element and said electrical energy source, said light-activated silicon controlled rectifier being located adjacent to said light-generating element.

3. An improved simulated candle as defined in claim 1 wherein said second means for allowing said light-generating element to be de-energized comprises a thin, electrically conductive strip with spring tension, said strip being firmly secured at one end to a terminal means, said terminal means being connected by an electric conductor means to one of the poles of said direct current electrical energy source; said strip making spring-tension contact at the second end thereof to a second terminal means, said second terminal means being connected to the appropriate lead, either anode or cathode, of said light-activated silicon controlled rectifier; and said strip having means secured thereto for accepting air current directed thereto, said means being secured to said strip thereby causing said strip to move laterally away from said second terminal means and thus cause series circuit including said light-activated silicon controlled rectifier to be open for the duration of said air current, said action causing said light-activated silicon controlled rectifier to turn off.

4. An improved simulated candle as defined in claim 1 wherein said third means for disposing said first two means in the candle structure in such manner as to afford said first two means protection comprises a cartridge containing at its top end a socket means for said light-generating element, said cartridge housing other electronic components pertaining to the circuitry of said candle, said cartridge being easily disposed in said elongated structure housing said electrical energy source, said cartridge being secured by detachable connection means at top end of said cartridge to the bottom end of a transparent protective housing or candle head, said candle head receiving thereinto said light-generating element being mounted in said light socket means and protruding outwardly therefrom, said detachable connection means providing easy access to said light-generating element, said candle head containing said light-activated silicon controlled rectifier, said light-activated silicon controlled rectifier making electrical contact to said components in said cartridge through said detachable connection means; and said cartridge and said candle head in combination being secured by a second detachable connection means to said elongated structure in such manner that said cartridge is inserted into top end of said elongated structure, said cartridge making electrical connection with said electrical energy source, and said candle head is detachably connected to top end of said elongated structure and in extension therewith, said second detachable connection means providing access to said electrical energy source for easy removal and replacement thereof.

* * * * *